US006298746B1

(12) United States Patent
Shaw

(10) Patent No.: US 6,298,746 B1
(45) Date of Patent: Oct. 9, 2001

(54) BRAKE PEDAL FOR MOTOR VEHICLE

(75) Inventor: Schuyler Scott Shaw, Dayton, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/285,143

(22) Filed: Apr. 1, 1999

(51) Int. Cl.[7] ..... G05G 1/14
(52) U.S. Cl. ..... 74/512; 74/560
(58) Field of Search ..... 74/512, 513, 560, 74/500.5–502.6; 180/90; 192/99 S; 123/399

(56) References Cited

U.S. PATENT DOCUMENTS

| | | | | |
|---|---|---|---|---|
| 4,353,430 | * | 10/1982 | Sjoqvist et al. | 180/90 |
| 4,522,082 | * | 6/1985 | Musumiya et al. | 74/512 |
| 4,800,773 | * | 1/1989 | Nakamura et al. | 74/500.5 |
| 5,215,176 | * | 6/1993 | Hamann | 192/99 S |
| 5,603,217 | | 2/1997 | Majersik et al. | 60/562 |
| 5,685,200 | * | 11/1997 | Baumann | 74/512 |
| 5,729,979 | | 3/1998 | Shaw et al. | 60/533 |
| 5,881,605 | * | 3/1999 | Doolittle et al. | 74/560 X |
| 5,934,152 | * | 8/1999 | Aschoff et al. | 74/513 |
| 5,937,707 | * | 8/1999 | Rixon et al. | 74/560 |

FOREIGN PATENT DOCUMENTS

| | | | | |
|---|---|---|---|---|
| 1164637 | * | 10/1958 | (FR) | 74/512 |
| 57-44750 | * | 10/1958 | (JP) | 123/399 |

* cited by examiner

*Primary Examiner*—Vinh T. Luong
(74) *Attorney, Agent, or Firm*—Robert M. Sigler

(57) ABSTRACT

A brake pedal for a motor vehicle brake-by-wire brake system including a pedal lever pivotally supported on a body of the motor vehicle, a foot pad on the pedal lever, and a compliant member having a plurality of parallel beams defining cantilever springs. A pedal force on the foot pad effects pedal travel of the pedal lever from a release position toward a brake full apply position. The parallel beams defining cantilever springs are arrayed in series between the pedal lever and the motor vehicle body and engage is series so that the effective stiffness of the compliant member increases during pedal travel. The stiffness of each of the parallel beams and the magnitudes of a plurality of clearance spans therebetween are "tuned" to yield a pedal force which initially increases slowly relative to pedal travel and then increases exponentially relative to pedal travel thereby emulating the relationship between pedal force and pedal travel of a brake pedal in a traditional motor vehicle brake system. Elastic pads on the parallel beams cushion the successive engagements of the parallel beams and blend the corresponding changes in stiffness of the compliant member.

6 Claims, 2 Drawing Sheets

BRAKE PEDAL FOR MOTOR VEHICLE

TECHNICAL FIELD

This invention relates to a motor vehicle brake pedal.

BACKGROUND OF THE INVENTION

A traditional motor vehicle brake system includes a plurality of hydraulically actuated wheel brakes, a master cylinder, and a brake pedal. The brake pedal includes a pedal lever on a body of the motor vehicle linked to a piston assembly in the master cylinder. To apply the wheel brakes, an operator pushes on a foot pad on the pedal lever to pivot the pedal lever and linearly stroke the piston assembly in the master cylinder. The linear stroke of the piston assembly is opposed or resisted by a force attributable to fluid pressure in the wheel brakes and in a plurality of hydraulic channels between the wheel brakes and the master cylinder. The "pedal force" with which the operator must push on the foot pad to apply the wheel brakes mirrors the fluid pressure force opposing the stroke of the master cylinder piston assembly and initially increases slowly relative to pivotal movement of the pedal lever, i.e. relative to "pedal travel", as compliance in the wheel brakes and in the hydraulic channels is taken up. Then, pedal force increases at an increasing rate, i.e. exponentially, relative to pedal travel as the wheel brakes become applied. Motor vehicle operators perceive this relationship between pedal travel and pedal force as the "feel" of the brake system and, because of the widespread use of such traditional brake systems for many years, expect generally the same feel from all motor vehicle brake systems. Accordingly, in a motor vehicle brake system in which fluid pressure to apply a wheel brake is created independently of a brake master cylinder by an electro-hydraulic apparatus such as a pump and an electric motor, i.e. in a "brake-by-wire" brake system, the brake pedal is adapted to artificially mimic or emulate the feel of the brake pedal in a traditional brake system. For example, brake pedals described in U.S. Pat. Nos. 5,729,979 and 5,603,217, issued Mar. 24, 1998 and Feb. 18, 1997, respectively, and assigned to the assignee of the this invention, include elastomeric compliant elements which, when squeezed, mimic the fluid pressure force which opposes pedal travel in a traditional motor vehicle brake system. A brake pedal according to this invention is a novel alternative to prior brake pedals which emulate, in a brake-by-wire brake system, the fluid pressure force which opposes pedal travel in a traditional motor vehicle brake system.

SUMMARY OF THE INVENTION

This invention is a new and improved brake pedal for a motor vehicle brake-by-wire brake system including a pedal lever pivotally supported on a body of the motor vehicle, a foot pad on the pedal lever, and a compliant member having a plurality of parallel beams thereon defining cantilever springs. A pedal force on the foot pad effects pivotal movement, i.e. "pedal travel", of the pedal lever from a release position toward a brake full apply position. The parallel beams defining cantilever springs are arrayed in series between the pedal lever and the motor vehicle body and engage successively so that the effective stiffness of the compliant member increases during pedal travel as succeeding ones of the parallel beams flex resiliently in cantilever spring bending. The stiffness of each of the parallel beams and the magnitudes of a plurality of clearance spans therebetween are "tuned" to yield a pedal force which initially increases slowly relative to pedal travel and then increases exponentially relative to pedal travel thereby emulating the relationship between pedal force and pedal travel of a brake pedal in a traditional motor vehicle brake system. Elastic pads on the parallel beams cushion the engagement of each parallel beam against the next succeeding parallel beam.

DESCRIPTION OF THE PREFERRED EMBODIMENT

Figure 1:
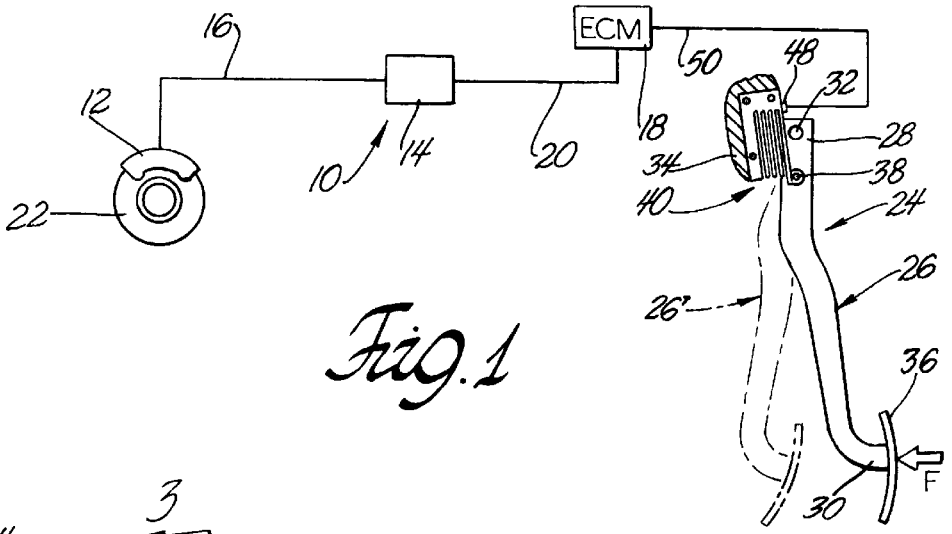
FIG. 1 is a fragmentary schematic representation of a motor vehicle brake-by-wire brake system including a brake pedal according to this invention.

Referring to FIG. 1, a schematically represented motor vehicle brake-by-wire brake system 10 includes a fluid pressure actuated wheel brake 12 connected to an electro-hydraulic fluid pressure apparatus 14, e.g. a pump driven by an electric motor, through a hydraulic channel 16. The fluid pressure apparatus 14 is controlled by an electronic control module ("ECM") 18 on the motor vehicle through a conductor 20 to selectively increase a fluid pressure in the hydraulic channel 16 and in the wheel brake 12 to apply the wheel brake to a brake rotor 22 on a wheel, not shown, of the motor vehicle and to release the rotor from the wheel brake by exhausting the fluid pressure in the hydraulic channel and in the wheel brake.

Figure 2:
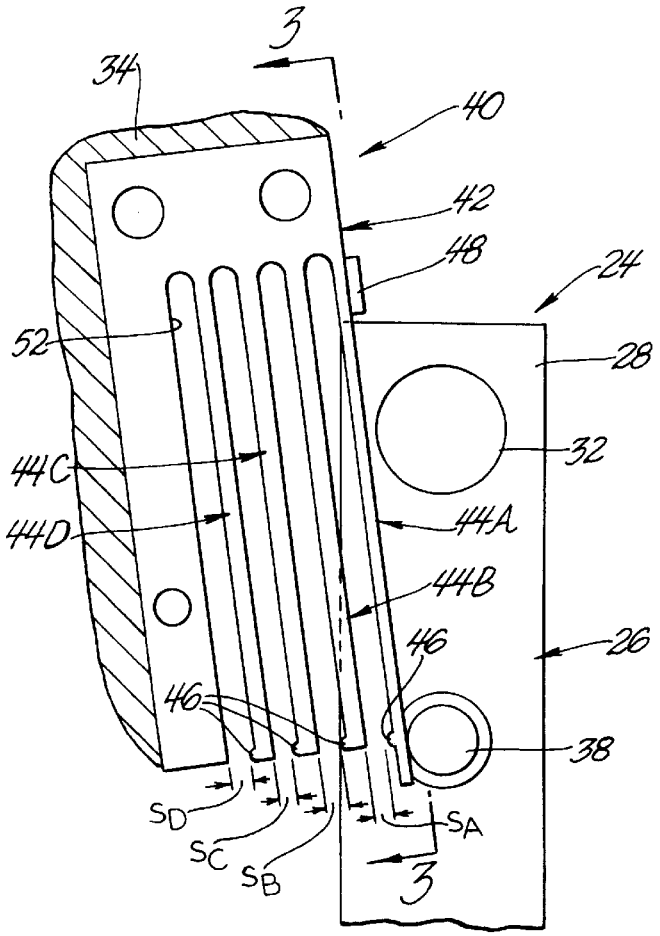
FIG. 2 is an elevational view of a compliant member of the brake pedal according to this invention.

As seen best in FIG. 2, a brake pedal 24 according this invention for the brake-by-wire brake system 10 includes a pedal lever 26 having an inboard end 28 and an outboard end 30. The pedal lever 26 is supported at its inboard end 28 on an axle pin 32 attached to a fragmentarily illustrated structural portion of a body 34 of the motor vehicle for back and forth pivotal movement between a release position illustrated in solid lines in FIGS. 1–2 and a brake full apply position 26', FIG. 1. A foot pad 36 is attached to a pedal lever 26 at the outboard end 30 thereof. The pedal lever 26 has an abutment thereon in the form of a reaction pin 38 rigidly attached to the pedal lever between the axle pin 32 and the foot pad 36.

A compliant member 40 of the brake pedal 24 includes an L-shaped structural frame 42 rigidly attached to the fragmentarily illustrated structural portion 34 of the motor vehicle body. The compliant member further includes a plurality of arms in the form of a plurality of flat, distinct, parallel beams 44A,44B,44C,44D each integral with and projecting from the short side or base 43 of the L-shaped structural frame 42 so as to be fixed in spaced relationship with the fixed ends of the other beams as shown in FIG. 2 and having a raised lug 46 at a free, distal end 45 thereof facing the next succeeding one of the parallel beams. The beams 44A, 44B, 44C and 44D are spaced from each other with a clearance span, as shown in FIG. 2; and the lugs on free ends 45 46 are separated from succeeding ones of the parallel beams by respective ones of a plurality of clearance spans $S_A$,$S_B$,$S_C$,$S_D$.

The compliant member 40 is made of a material, e.g. spring steel or polymer composite, which is resiliently flexible so that each of the parallel beams 44A–44D constitutes a cantilever spring. The end parallel beam 44A is disposed in the path traversed by the reaction pin 38 on the pedal lever 26 during pivotal movement of the pedal lever from its release position toward its brake fully apply position 26'. Each of the parallel beams 44B–44D obstructs resilient flexure in cantilever spring bending of the adjacent one of the parallel beams closer to the end parallel beam 44A after the adjacent one of the parallel beams is bent beyond an initial range of beam bending in which there is no engagement between the beams so that the cantilever springs constituted by the parallel beams are arrayed in series between the pedal lever and the body of the motor vehicle. A schematically represented transducer 48, e.g. a strain gage, Hall Effect sensor, fiber optic sensor, or the like, on the end parallel beam 44A is electronically linked to the ECM 18 through a schematically represented conductor 50.

In operation, the pedal lever 26 assumes its release position when the foot of an operator of the motor vehicle is removed from the foot pad 36. In the release position of the pedal lever, the reaction pin 38 bears against the end parallel beam 44A on the compliant member without significantly flexing the end parallel beam in cantilever spring bending. A corresponding the electronic signal from the transducer 48 to the ECM 18 characteristic of the absence of flexure of the end parallel beam causes the ECM to control the fluid pressure apparatus 14 to exhaust the fluid pressure in the hydraulic channel 16 and in the wheel brake 12 to release the brake rotor 22 from the wheel brake.

Figure 3:
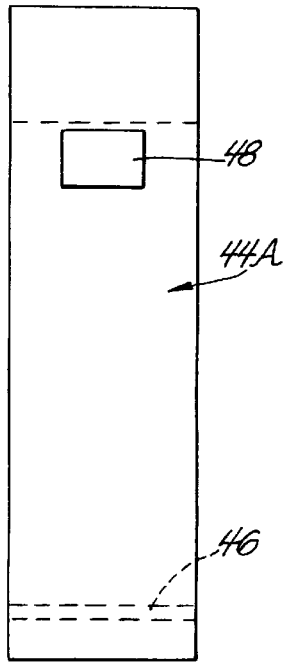
FIG. 3 is a view taken generally along the plane indicated by lines 3—3 in FIG. 2.
Figure 4:
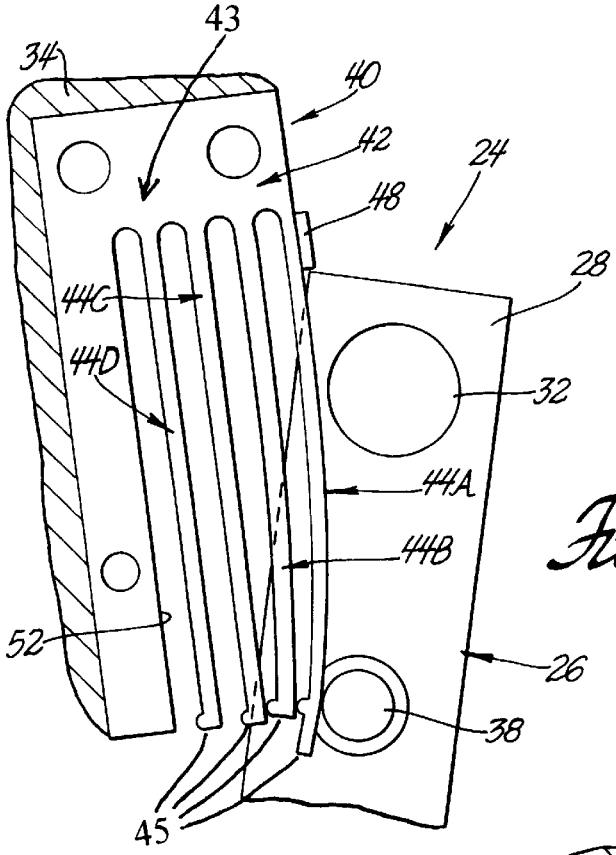
FIG. 4 is similar to FIG. 2 but illustrating structural elements of the compliant member of the brake pedal according to this invention in different relative positions.

To stop or slow the motor vehicle, the operator pushes on the brake pedal 24 by applying a pedal force, schematically represented by a vector force "F", on the foot pad 36. The pedal lever 26 pivots clockwise, FIGS. 1–3, in response to application of the pedal force F thereby to mimic the pivotal movement of the pedal lever of a brake pedal in a traditional motor vehicle brake system. At the same time, the reaction pin 38 commences flexure of the end parallel beam 44A of the compliant member 40 in cantilever spring bending. A corresponding electronic signal from the transducer 48 characteristic of pedal travel and pedal force causes the ECM 18 to actuate the fluid pressure apparatus 14 to increase the fluid pressure in the hydraulic channel 16 and in the wheel brake 12 to squeeze the wheel brake against the brake rotor 22.

As the pedal lever pivots from its release position toward its brake full apply position 26', the end parallel beam 44A flexes resiliently in cantilever spring bending through the span $S_A$. In the corresponding interval of pedal travel, the effective stiffness of the compliant member 40 is attributable to resilient flexure of only the end parallel beam 44A. At the end of the span $S_A$, the lug 46 on the end parallel beam 44A seats on the next succeeding parallel beam 44B so that continued pivotal movement of the pedal lever induces concurrent resilient flexure of both parallel beams 44A,44B in cantilever spring bending through the next succeeding span $S_B$. In the corresponding second interval of pedal travel, the effective stiffness of the compliant member 40 is attributable to resilient flexure of both of the parallel beams 44A,44B and, therefore, exceeds its effective stiffness in the first interval of pedal travel. Similarly, in the spans $S_C$,$S_D$, the effective stiffness of the compliant member 40 increases further in response to successive flexure in cantilever spring bending of the parallel beams 44C,44D, respectively. At the end of the corresponding fourth interval of pedal travel, the parallel beams 44A–44C are stacked solidly against a side 52 of the frame 42 of the compliant member and define the brake full apply position of the pedal lever.

Figure 5:
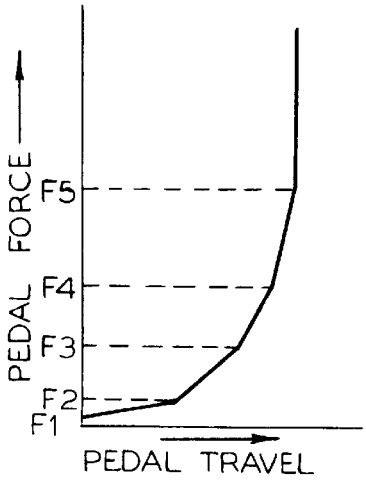
FIG. 5 is a graphic representation of the relationship between pedal force and pedal travel for the brake pedal according to this invention.

The stiffness of each of the parallel beams 44A–44D in cantilever spring bending and the spans $S_A$–$S_D$ therebetween are calculated or "tuned" to yield a relationship between pedal force and pedal travel which mimics or emulates the corresponding relationship in a traditional motor vehicle brake system. For example, when the operator first engages the foot pad 36, the end parallel beam 44A remains rigid until the pedal force F attains a small first magnitude $F_1$, FIG. 5. Then, as the end parallel beam 44A flexes resiliently in cantilever spring bending in the first interval of pedal travel, the pedal force F increases slowly relative to the pedal travel to a second magnitude $F_2$ to emulate the feel of the brake pedal in the traditional motor vehicle brake system when compliance is eliminated from the hydraulic channels and the wheel brakes. In the second, third and fourth intervals of pedal travel, the pedal force F increases at an increasing rate, i.e. exponentially, relative to pedal travel through a third magnitude $F_3$, a fourth magnitude $F_4$, and up to a fifth or maximum magnitude $F_5$ in the full brake apply position 26' of the pedal lever to emulate the feel of the brake pedal in the traditional motor vehicle brake system when the wheel brakes become applied.

When the operator releases the foot pad 36, the cantilever springs defined by the parallel beams 44A–44D resiliently unbend and thrust the pedal lever 26 back to its release position. At the same time, the transducer 48 electronically signals the ECM 18 to control the electro-hydraulic apparatus 14 to exhaust the fluid pressure in the hydraulic channel 16 and in the wheel brake 12 to release the brake rotor 22 from the wheel brake.

Figure 6:
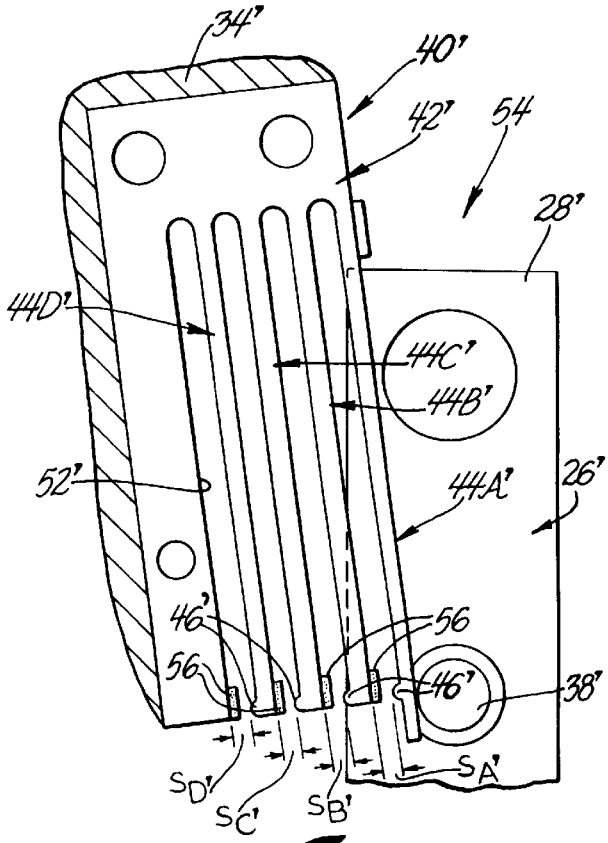
FIG. 6 is view of a compliant member of a modified brake pedal according to this invention.

A modified brake pedal 54 according to this invention is fragmentarily illustrated in FIG. 6. In FIG. 6, structural elements common to the brake pedal 24 and to the modified brake pedal 54 are identified by primed reference characters. The modified brake pedal 54 includes a pedal lever 26' pivotally supported on a structural portion 34' of a body of a motor vehicle at an inboard end 28' thereof. A compliant member 40' of the brake pedal 54 includes a structural frame 42' rigidly attached to the structural portion 34' of the vehicle body and a plurality of integral, flat, parallel beams 44A'–44D' each having a raised lug 46' at a distal end thereof. The lugs 46' are separated from succeeding ones of the parallel beams by respective ones of a plurality of clearance spans $S_A'$, $S_B'$, $S_C'$, $S_D'$. Respective ones of a plurality of elastic pads 56 are attached to the beams 44B'–44D' facing the parallel beams 44A'–44C'. Another elastic pad 56 is attached to a side 52' of the structural frame of the compliant member 40' facing the parallel beam 44D'.

To stop or slow the motor vehicle, the operator pushes on the brake pedal 54 by applying a pedal force on a foot pad, not shown, on the pedal lever 26'. The pedal lever pivots clockwise from a release position, FIG. 6, in response to application of the pedal force. At the same time, a reaction pin 38' on the pedal lever commences flexure of the end parallel beam 44A' in cantilever spring bending. Toward the end of the span $S_A'$, the lug 46' on the end parallel beam 44A' engages the elastic pad 56 on the next succeeding parallel beam 44B' and squeezes the pad until the parallel beam 44B' commences resilient flexure in cantilever spring bending concurrent with the parallel beam 44A'. Likewise, toward the ends of the spans $S_B'$–$S_D'$, the lugs 46' on the parallel beams 44B'–44D' squeeze the pads 56 until the parallel beams commence resilient flexure in cantilever spring bending or become stacked against the side 52' of the structural frame of the compliant member. The elasticity of the pads 56 cushions engagement of the lugs 46' on the parallel beams and on the side 52' which engagement otherwise occurs with an abruptness which may be perceptible to the motor vehicle operator. The pads 56 also blend the changes in stiffness of the compliant member 40' which occur when succeeding ones of the parallel beams commence cantilever spring bending.

What is claimed is:

1. A motor vehicle brake pedal for a brake-by-wire brake system including a pedal lever pivotally supported at an inboard end thereof on a body of the motor vehicle for pedal travel from a release position to a brake full apply position, an abutment means on the pedal lever, a compliant member on the body of the motor vehicle engageable by the abutment means on the pedal lever during pedal travel, and a foot pad on the pedal lever outboard of the abutment means whereat a pedal force is applied to effect pedal travel of the pedal lever from the release position to the brake full apply position against an effective stiffness of the compliant member, characterized in that the compliant member comprises:

a base;

a plurality of distinct parallel beams projecting from the base, each of the beams having a flexible portion including a free end, the flexible portion being resiliently flexible in beam bending, each of the beams being spaced from an adjacent one of the beams by a clearance span that permits bending through an initial range without engaging the adjacent one of the beams but ensures engagement with the adjacent one of the beams in beam bending beyond the initial range, whereby an effective stiffness of the compliant member is increased by successive serial engagement of each of the beams with the adjacent one of the beams during extended bending of an end one of the beams, and the base having a mounting means operative to support the compliant member on the body of the motor vehicle with the end one of the beams disposed facing the abutment means of the pedal lever for engagement therewith and extended bending thereof during pedal travel of the pedal lever from the release position to the full brake apply position.

2. The motor vehicle brake pedal for a brake-by-wire brake system recited in claim 1 wherein:

a stiffness of each of the parallel beams in cantilever spring bending and respective ones of the clearance spans between the parallel beams are calculated to vary the effective stiffness of the compliant member such that the pedal force increases at a first rate relative to pedal travel in a first interval of pedal travel and at a second rate exceeding the first rate during pedal travel beyond the first interval.

3. The motor vehicle brake pedal for a brake-by-wire brake system recited in claim 2 further comprising:

a plurality of elastic pads on respective ones of the parallel beams for cushioning successive serial engagement between succeeding ones of the parallel beams during serial resilient flexure thereof in cantilever spring bending and for blending the changes in stiffness of the compliant member which occur when succeeding ones of the parallel beams commence cantilever spring bending.

4. The motor vehicle brake pedal for a brake-by-wire brake system recited in claim 3 wherein the mounting means operative to support each of the plurality of parallel beams on the body of the motor vehicle for successive serial resilient flexure in cantilever spring bending comprises:

a structural frame rigidly attached to the body of the motor vehicle having a plurality of integral arms defining respective ones of the plurality of parallel beams.

5. The motor vehicle brake pedal for a brake-by-wire brake system recited in claim 4 further comprising:

a transducer means connected to the end one of the plurality of parallel beams facing the abutment means on the pedal lever, the transducer means being operative to provide an electronic signal proportional to the magnitude of the pedal force and the magnitude of the pedal travel when the end one of the parallel beams is flexed in cantilever spring bending by the abutment means on the pedal lever.

6. The motor vehicle brake pedal for a brake-by-wire brake system recited in claim 5 wherein the transducer means comprises:

a device on the end one of the plurality of parallel beams facing the abutment means on the pedal lever selected from a group consisting of a strain gage and a Hall Effect sensor and a fiber optic sensor.

* * * * *